United States Patent [19]

Tighe et al.

[11] Patent Number: 4,864,089

[45] Date of Patent: Sep. 5, 1989

[54] LOCALIZED MICROWAVE RADIATION HEATING

[75] Inventors: Laurence E. Tighe, Milford; Tim Parker, Shrewsbury, both of Mass.

[73] Assignee: Dennison Manufacturing Company, Framingham, Mass.

[21] Appl. No.: 194,260

[22] Filed: May 16, 1988

[51] Int. Cl.[4] ..... H05B 6/64

[52] U.S. Cl. ..... 219/10.55 E; 219/10.55 F; 219/10.55 M; 99/DIG. 14; 426/107; 426/241; 426/243

[58] Field of Search ..... 219/10.55 E, 10.55 F, 219/10.55 R, 10.55 M; 426/127, 234, 243, 107, 241; 427/383.1, 126.1; 99/451, DIG. 4

[56] References Cited

U.S. PATENT DOCUMENTS

| | | | |
|---|---|---|---|
| 4,518,651 | 5/1985 | Wolfe | 219/10.55 E |
| 4,612,431 | 9/1986 | Brown | 219/10.55 E |
| 4,640,838 | 2/1987 | Isakson | 219/10.55 E |
| 4,656,325 | 4/1987 | Keefer | 219/10.55 E |
| 4,661,671 | 4/1987 | Maroszek | 219/10.55 E |
| 4,751,358 | 6/1988 | Durand | 426/243 |

FOREIGN PATENT DOCUMENTS 0276654 8/1988 European Pat. Off. .

*Primary Examiner*—A. D. Pellinen
*Assistant Examiner*—Leon K. Fuller
*Attorney, Agent, or Firm*—Barry D. Josephs; Arthur B. Moore

[57] ABSTRACT

A medium formed by a resin binder with conductive and semiconductive particles that can be coated on a substrate to convert electromagnetic radiation to heat. Conversion efficiency can be controlled by the choice and amount of materials used in the medium, which can be used repeatedly without burn out.

14 Claims, 3 Drawing Sheets

FIG. 1
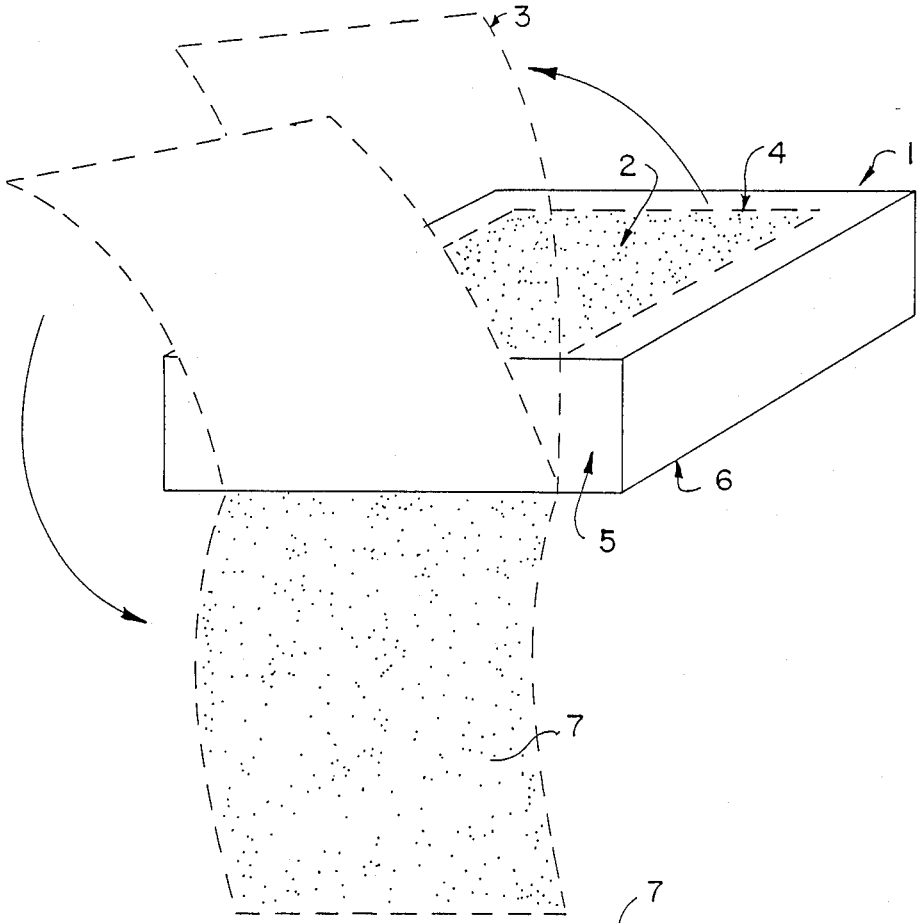
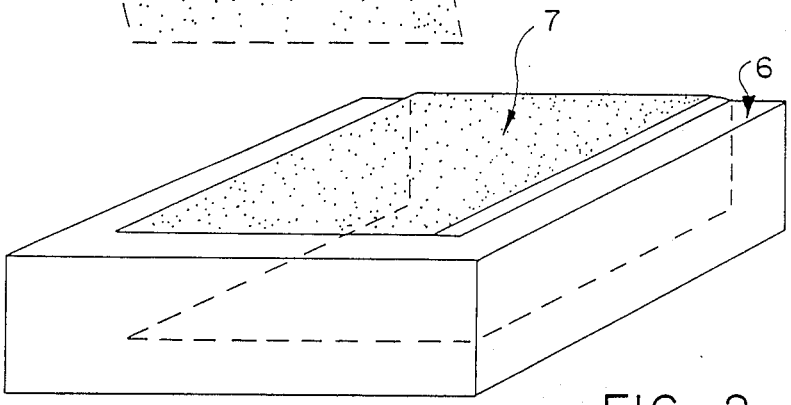
FIG. 2

LOCALIZED MICROWAVE RADIATION HEATING

BACKGROUND OF THE INVENTION

This invention relates to localized radiation heating and more particularly to localized heating in microwave appliances.

In microwave heating, it can be desirable to provide localized surface heating to achieve such effects as browning and crisping. While the typical microwave oven is a suitable energy source for uniform cooking, it is not satisfactory for selective heating effects, such as browning and crisping. In fact, the typical microwave arrangement produces the cooking in which the external surface of the cooked material, particularly if desired to be crispy, tends to be soggy and unappetizing in appearance.

One attempt to provide suitable browning and crisping of microwave cooked foods has been by the selective use of virtually transparent, thin metallized aluminum coatings. Such material can produce heat and provide the desired crisping. The difficulty with this thickness of metal is that it can produce arcing and defeat the microwave operation.

Another attempt to provide the desired heating effect has been by the suggested use of carbon black coatings. These do not produce arcing but are generally found to be unsatisfactory because they produce a run-away heating effect.

Accordingly, it is an object of the invention to facilitate the selective radiation heating of objects, particularly food. A related object is to improve the taste and texture of microwave heated foods. Another object is to maintain the wholesomeness and nutritional value of food.

A further object of the invention is to overcome the disadvantages experienced in the use of thin metallic coatings in attempting to supply a supplemental heating effect in microwave cooking.

Still another object of the invention is to overcome the disadvantages that have been experienced in obtaining localized heating effects. A related object is to overcome the difficulties that have prevented carbon black coatings from being used for localized heating.

SUMMARY OF THE INVENTION

In accomplishing the foregoing and related objects, the invention provides a medium for selected conversion of radiation to heat in which a fluid carrier is used to disperse conductive and semiconductive substances. The conductive substances desirably are flakes, powder, needles, fiber and fluff, for example, of a metal such as aluminum and the semiconductive substances are particles, for example, of carbon.

The medium is used as a coating or to provide a print pattern of a radiation heating susceptor of conductive and semiconductive substances. It is speculated that the semiconductive substances provide a bridging effect with respect to the metallic substances so that the metallic substances are able to provide a desired controlled localized heating effect without arcing. At the same time, the combination of the semiconductor materials with the metallic substances avoids the runaway heating effect that can occur with homogeneous materials such as carbon black particles.

The medium desirably, includes an antioxidant, a solvent to control viscosity, a fluid carrier which a resin in solution by a primary solvent, and a diluent. The resin is selected from the class consisting of polysulphones, polyethersulphones, polyolefins, epoxies, phenolics, polystyrenes, phenoxies, halocarbons, acrylics and vinyls.

The fluid carrier can include a dispersant solution formed by a solvent or solvent blend and a wetting agent for the substances being dispersed.

A microwave susceptor coating package in accordance with the invention includes a substrate and a susceptor coating on the substrate. The susceptor coating is a combination of semiconductor particles and metallic particles. The ratio of metal to semiconductor is in the range from about 5–30:1, with about 13:1 preferred. The semiconductor can be carbon black. The metal may be flaked or powdered and is selected from the class of nickel, iron, zinc, copper or aluminum.

The microwave susceptor coating is formed from metallic particles accompanied by a substance for reducing the arc effect of the metallic particles. The steps of forming the coating include providing a resin solution, providing a dispersant solution, combining the solutions and dispersing particles into the combined solutions or dispersing the particles in the dispersion solution and combining that mixture with the resin solution.

DESCRIPTION OF THE DRAWINGS

Other aspects of the invention will become apparent after considering an illustrative embodiment taken in conjunction with the drawings in which:

FIG. 1 is a perspective view of a microwavable food package which has been adapted in accordance with the invention;

FIG. 2 is a perspective view of the package of FIG. 1 which is adapted for localized microwave heating;

DETAILED DESCRIPTION

Figure 3:
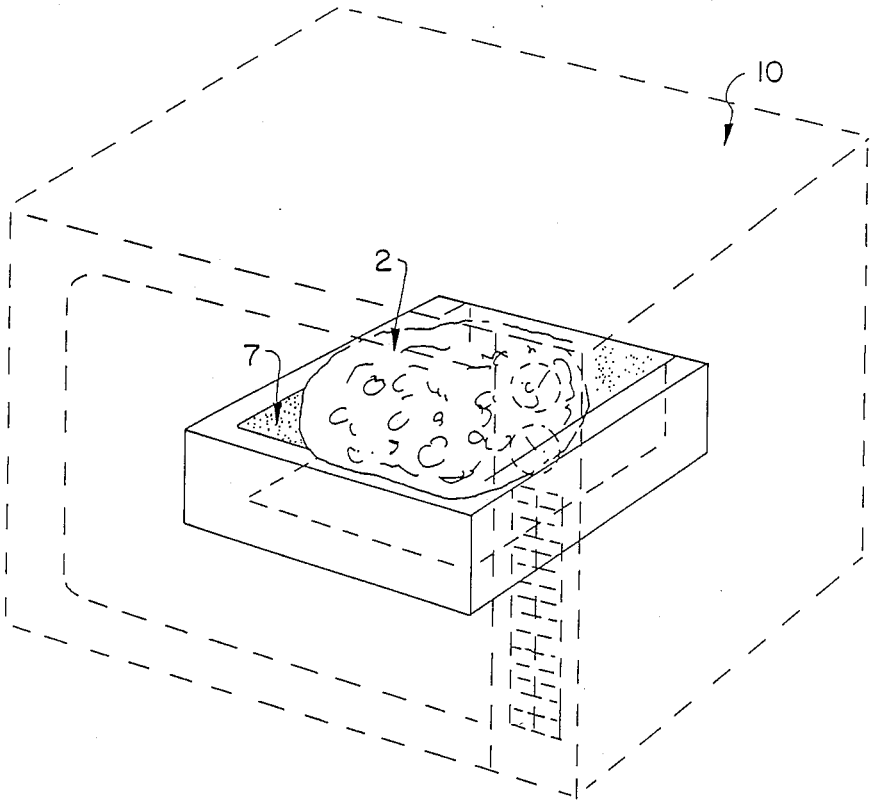
FIG. 3 is a perspective view showing the invention in use in a microwave oven.

With reference to the drawings, a package for microwave cooking is shown in FIG. 1. The package (1) includes a food product (2) within its interior and a removable cover (3) that is removable along a set of incised lines (4). As illustrated in FIG. 1, once the incision is broken, the cover (3) can be elevated to various positions. Three positions are shown in FIG. 1, a preliminary position where the flap has been elevated to the outer side wall (5) of the package, a second position shows the flap being removed from the outer edge and the third position shows the flap extended downwardly.

In FIG. 2 the flap has been folded over the base (6) exposing a "susceptor" coating (7) which provides localized heating in accordance with the invention. The term "susceptor" is commonly used to designate a coating that provides localized heating by absorbing electromagnetic radiation and converting it to thermal energy.

The package of FIG. 2 is insertable into a microwave oven (FIG. 3) with the food item (2) that is to be crispened placed upon the susceptor coating (7).

The susceptor coating shown in FIGS. 2 and 3 provides microwave crisping and browning without the disadvantages that accompanied the prior art.

The susceptor coating of the invention is formed by a combination of metallic powder or flake, carbon and a resin binder. The heating strength of the susceptor coating is controlled by the coat weight (mass), geometry, resin properties (i.e. glass transition temperature) as well as the pigment particle size, choice of metal, pigment to binder ratio and the metal to carbon black ratio.

In use, the susceptor coating may be applied to a film substrate including but not limited to polyester, polyimide, polyetherimide, nylon, cellophane, polyethersulphone or polyvinylidene chloride which is laminated to paperboard. The susceptor coating may also be applied to the package or cooking container, such as a tray. This is used as a cooking surface for the item to be crispened and browned.

The invention provides a microwave susceptor which is not limited to the tight deposition tolerances that are required in metallized susceptors. In addition the coating of the laminate can be printed in various shapes and sizes, be thermoformable and transferable from a release surface.

Conventional metal susceptor coatings do not heat without arcing and can only be used once; carbon black susceptor coatings can burn because of run-away heating.

Variability of heating strength can be controlled by formula modification and pattern. The prior art of metallized aluminum coatings did not provide for variability in heating. Various sizes and shapes of susceptor patterns can be printed with the invention. This provides an advantage over the prior art in which sizes and shapes must be controlled by masking before metallizing or etching after metallizing. The invention is reusable and can be printed on permanent cookware or reusable trays.

Figure 4:
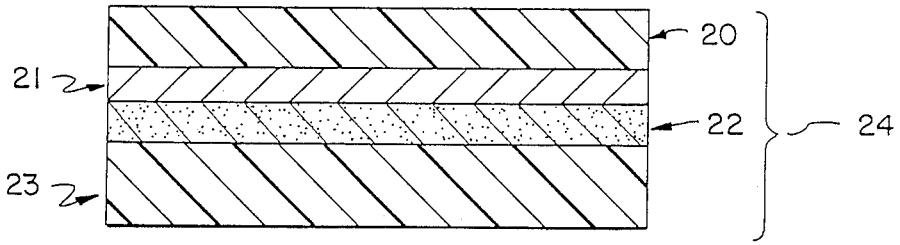
FIG. 4 PRIOR ART
FIG. 4 is a perspective view of the microwave susceptor constriction used in the prior art.

The prior art is illustrated by the laminate of FIG. 4. In this laminate (24), a ½ mil (0.013 mm) layer or film of olyethylene terephthalate is used as the carrier (20). Upon this is deposited a 15–20 angstroms thickness of vacuum-metallized aluminum (21) that provides a surface resistivity varying between 20 and 50 ohms per square. Overlying the aluminum layer is an adhesive (22) such as ethylene vinyl acetate and an overlying cellulosic layer (23). When exposed to microwave radiation this susceptor heats up but soon shuts off like a fuse. During the heating cycle this susceptor is prone to arcing.

The invention provides a combination of carbon and metallic particles such as nickel, iron, copper, zinc or aluminum. The particles are 1–19 microns in size. The metal/carbon ratio is on the order of 13/1. By using a mixture of metal and carbon arcing is eliminated. It is believed that 15–70 nm particles of carbon provide a semiconductive bridge which maintains metal particle spacings and avoids arcing. Another result is a reusable susceptor. The relationship between the carbon and the metal particles is about 1 to about 5–30 parts by weight. An appropriate ratio is about 1 to 13. As the amount of metal is increased, there is a drop in heating ability. Too much carbon limits utility due to arcing or burning and is avoided.

The coating mass affects the amount of heating. As an example, for one formula, a coating thickness of 19 microns is needed to achieve 260° C. and a thickness of 13 microns is needed to achieve 165° C. Thermoplastic resins are desired for the binder to keep the pigments from overheating. This is related to the glass transition temperature $T_g$. As the $T_g$ is reached the binder expands so that at some point the pigment to pigment contact will be lost thereby preventing further heating until the binder cools down and contracts making the pigment particles contiguous again. For polyethersulphone ($T_g$=229° C.) the temperature plateau is 266° C. as compared with 182° C. for polyamide ($T_g$=101° C.) For low pigment loadings thermoset resins are acceptable.

In one example in accordance with the invention, a microwave susceptor coating was formulated beginning with a resin solution of 45.26 parts by weight and a dispersant solution of 4.83 parts by weight. Lecithin was used as a secondary dispersant, 0.20 parts by weight. To control viscosity, 9.58 parts of solvent, e.g., dimethyl formamide, and 9.58 parts of diluent, i.e., methylethylketone, were added to the resin and dispersant solutions. The resin solution was comprised of a diluent at 40 parts by weight and a primary solvent at 40 parts by weight with polyethersulphone as the resin at 20 parts by weight. The polyethersulphone has a glass transition temperature of 229° C. The dispersant solution was comprised of the diluent at 40 parts by weight, the primary solvent at 40 parts by weight and the dispersing agent, a polyester/polyamide copolymer, at 20 parts by weight.

To this were added 6 to 9 microns aluminum particles at 28.35 parts by weight and 2.16 parts of carbon black which were high surface area aggregates of hollow shell-like particles. A phenolic oxamide antioxidant was used to retard oxidation of the metal. A 19 microns thick dried coating of this formula applied to a polyimide substrate heated a contiguous ceramic plate, without a food heat sink, to 254° C. in 2 minutes with a 700 watt output microwave oven.

A second coating example was formulated in the same manner as the first but the amounts of aluminum and carbon black were changed to give an aluminum to carbon black ratio of 8 to 1. Coatings of 19 microns or 13 microns thickness would burn when exposed to microwaves but a 6 microns thick coating would heat a contiguous ceramic plate to 247° C. in 2 minutes.

In a third example the aluminum to carbon black ratio was the same as in example 1, but the total pigment (aluminum and carbon) to binder ratio was 1:1. A 19 microns thick coating heated the ceramic plate to 241° C.

For example 4 the polyethersulphone and the primary solvent of example 3 were replaced with vinyl chloride-vinyl acetate copolymer and an appropriate primary solvent, such as toluene, respectively. A ceramic plate was heated by a 19 microns thick coating to 177° C. in 2 minutes.

In example 5 the vinyl resin and diluent of example 4 were replaced by polyamide and an alcohol, respectively. The heating test yielded a result of 154° C. for a 19 microns thick coating.

For example 6, a coating similar to that in example 3 was made but aluminum was replaced by copper (1–5 microns). A 19 microns thick coating produced a 172° C. result.

Example 7 is the same as example 6 but copper was replaced by nickel (1–5 microns). The result was 266° C.

In example 8, the resin and solvents of example 7 were replaced by a liquid two part epoxy system. The ratio of diglycidal ether of bisphenol A (epoxy) to polyamide hardener is 100:33–125. Similar results were achieved.

What is claimed is:

1. A microwave susceptor package for controlled conversion of microwave radiation to heat to brown or crispen food contained in the package without causing arcing, comprising:

a substrate which is configured to hold food to be heated; and a fluid medium coated or selectively printed on said substrate, comprising a reisn binder selected from the groups consisting of polysulfones, polyethersulfones, polyolefins, epoxies, phenolics, polystyrenes, phenoxies, halocarbons, acrylics, and vinyls; and a filler comprising metallic particles and semiconductor carbon black particles dispersed in said resin binder in a weight ratio of metallic particles to semiconductor particles of between 5:1 to 30:1, said metallic particles being selected from the group consisting of nickel, iron, zinc, copper, and aluminum particles.

2. The microwave susceptor package of claim 1 wherein the metallic particles comprise aluminum flake, powder, fluff, fiber or needles with a particle size in the range 1–19 microns.

3. The microwave susceptor package of claim 1 wherein the carbon black particles have a particle size in the range 15–70 microns.

4. The microwave susceptor package of claim 1 wherein the fluid medium further comprises an antioxidant.

5. The microwave susceptor package of claim 1 wherein the fluid medium prior to printing or coating on the substrate further comprises excess solvent and diluent to control viscosity.

6. The microwave susceptor package of claim 1 wherein the substrate comprises a plastic film laminated to paperboard.

7. The microwave susceptor package of claim 6 wherein the plastic film is selected from the group consisting of polyester, polyimide, polyetherimide, nylon, cellophane, polyethersulphone and polyvinylidine chloride.

8. The microwave susceptor package of claim 1 wherein the weight ratio of metallic particles to carbon black particles is about 13:1.

9. The microwave susceptor package as defined in claim 1 wherein the substrate comprises a ceramic tray.

10. A microwave susceptor package for controlled conversion of microwave radiation to heat to brown or crispen food contained in the package without causing arcing, comprising:

a substrate which is configured to hold food to be heated; and a fluid medium coated or selectively printed on said substrate, comprising a resin binder selected from the group consisting of polysulfones, polyethersulphones, epoxies, phenolics, polystyrenes, phenoxies, halocarbons, acrylics, and vinyls; and a filler comprising aluminum particles and carbon black particles dispersed in said resin binder in a weight ratio of aluminum to particles carbon black particles from 5:1 to 30:1.

11. A method of producing a microwave susceptor package or container for controlled conversion of microwave radiation to heat without causing arcing during use, comprising:

(a) mixing a resin solution and a dispersant solution, said resin solution comprising a heat resistant thermoplastic or thermoset resin;

(b) dispersing metallic particles and carbon black particles in said mixture in a weight ratio from 5:1 to 30:1 metallic particles to carbon black particles, said metallic particles being selected from the group consisting of nickel, iron, zinc, copper, and aluminum particles; and depositing the resulting material on a substrate.

12. The method of claim 11 wherein the depositing step comprises coating.

13. The method of claim 11 wherein the depositing step comprises selective printing.

14. The method of claim 11 wherein the dispersant solution comprises a diluent and a wetting agent.

* * * * *